US009254854B2

(12) United States Patent
Bode et al.

(10) Patent No.: US 9,254,854 B2
(45) Date of Patent: Feb. 9, 2016

(54) METHOD AND DEVICE FOR DETERMINING THE TRAIN LENGTH OF A PLURALITY OF COUPLED RAILWAY TRACTION VEHICLES

(75) Inventors: Christian Bode, Braunschweig (DE); Karsten Rahn, Cremlingen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 438 days.

(21) Appl. No.: 13/640,076

(22) PCT Filed: Mar. 31, 2011

(86) PCT No.: PCT/EP2011/054995

§ 371 (c)(1),
(2), (4) Date: Nov. 19, 2012

(87) PCT Pub. No.: WO2011/124519

PCT Pub. Date: Oct. 13, 2011

(65) Prior Publication Data

US 2013/0206487 A1 Aug. 15, 2013

(30) Foreign Application Priority Data

Apr. 7, 2010 (DE) ..... 10 2010 014 333

(51) Int. Cl.
*B61L 25/04* (2006.01)
*B61L 15/00* (2006.01)
*B61L 25/02* (2006.01)

(52) U.S. Cl.
CPC ..... *B61L 25/04* (2013.01); *B61L 15/0036* (2013.01); *B61L 25/028* (2013.01)

(58) Field of Classification Search
CPC .... B61L 25/028; B61L 25/04; B61L 15/0036
USPC ..... 701/19; 702/97, 158
See application file for complete search history.

(56) References Cited

U.S. PATENT DOCUMENTS

| | | | | |
|---|---|---|---|---|
| 3,532,228 | A | 10/1970 | Beyer | |
| 5,651,517 | A | 7/1997 | Stevens et al. | |
| 6,144,900 | A * | 11/2000 | Ali et al. | 701/19 |
| 6,172,619 | B1 | 1/2001 | Lumbis et al. | |
| 8,274,180 | B2 | 9/2012 | Homma et al. | |
| 2008/0243320 | A1 | 10/2008 | Otsubo et al. | |
| 2010/0219682 | A1 * | 9/2010 | Homma et al. | 307/9.1 |

FOREIGN PATENT DOCUMENTS

| | | | |
|---|---|---|---|
| CA | 2461066 | A1 | 9/2004 |
| CN | 101327805 | A | 12/2008 |

(Continued)

*Primary Examiner* — John Q Nguyen
*Assistant Examiner* — Anshul Sood
(74) *Attorney, Agent, or Firm* — Laurence Greenberg; Werner Stemer; Ralph Locher

(57) ABSTRACT

A method and a device for determining a train length of a plurality of coupled railroad traction vehicles, each having a vehicle device with an ID specific to the railroad traction vehicle, include determining the train length of arbitrarily long train sets in a secure and simple signaling manner by having vehicle devices determine if the railroad traction vehicle is coupled on one side or both sides by evaluating coupling contacts. The IDs of all of the coupled railroad traction vehicles or ID pairs indicating adjoining relationships of railroad traction vehicles directly coupled to one another are successively transmitted to a particular vehicle device by digital I/O connections between the vehicle devices. The device determines the train length as a function of received IDs or ID pairs.

3 Claims, 1 Drawing Sheet

(56) References Cited

FOREIGN PATENT DOCUMENTS

| | | | |
|---|---|---|---|
| DE | 10107571 | A1 | 5/2002 |
| DE | 101 40 052 | C1 | 2/2003 |
| DE | 10314316 | B3 | 9/2004 |
| EP | 1 031 488 | A1 | 8/2000 |
| EP | 1279581 | A1 | 1/2003 |
| EP | 2213545 | A1 | 8/2010 |
| WO | 2009069328 | A1 | 6/2009 |

* cited by examiner

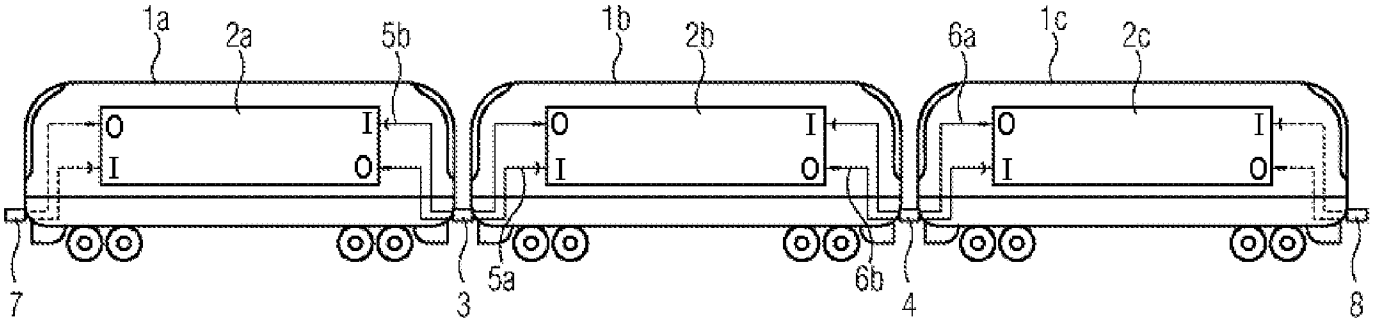
1a
2a
5b
1b
2b
5a
3
1c
2c
6a
4
6b
7
8
I
O

METHOD AND DEVICE FOR DETERMINING THE TRAIN LENGTH OF A PLURALITY OF COUPLED RAILWAY TRACTION VEHICLES

BACKGROUND OF THE INVENTION

Field of the Invention

The invention relates to a method for determining the train length of a plurality of coupled railroad traction vehicles which each have a vehicle device with traction-vehicle-specific ID (identification number) as well as a device which is suitable for carrying out the method.

One of the greatest challenges in rail-bound transportation systems, in particular short-distance transportation systems, is reliable determination of the train length when a plurality of railroad traction vehicles are coupled to form one train set. The reliable determination of the train length is highly significant for train control systems in which the vehicle travels at the absolute braking distance (moving block) or when station platform doors have to be reliably controlled as a function of the train length. A precondition for determination of the train length within the train set is a reliable communication connection between all the coupled railroad traction vehicles. However, in particular in the case of relatively old railroad traction vehicles only a small number of contacts are available at the railroad traction vehicle couplings, which contacts are almost completely occupied when newly equipped with modern train control systems. Furthermore, the coupling contacts are frequently of such poor quality that in order to set a high-quality communication connection considerable additional expenditure is necessary, for example preliminary fusing of the coupling contacts.

A device for external measurement of train length during travel is known from DE 101 40 052 C1. However, in the modern operating concepts such as, for example, FFB (Funkfahrbetrieb [radio-controlled railroad operating method]) or ETCS (European Train Control System Level 3), efforts are made to export as many functions as possible, for example determination of location, determination of train length and determination of train completeness, to the rail vehicle.

In modern train control systems there is usually a continuous communication connection, in particular bus connection, between the vehicle devices of the railroad traction vehicles which are coupled to one another. The lengths of the individual railroad traction vehicles are therefore exchanged between the vehicle devices. However, this information alone cannot be used for technical safety purposes since a failed or switched-off vehicle device cannot communicate and therefore would not be taken into account during the determination of the train length. In addition, in particular in the case of PLC (power line communication) or radio communication, crosstalk with a railroad traction vehicle on an adjacent platform cannot be ruled out. Consequently, a communication connection which is only in the form of a bus connection between the coupled railroad traction vehicles is not sufficient to be able to reliably detect the train length and the composition of the train set in terms of signaling equipment. Various known approaches are therefore based on the combination of the bus connection with further types of communication.

In a known solution, the coupling contact interrogations which are usually present are used for this. As a result it is known which side a railroad traction vehicle is coupled to. It is assumed that this information is available with sufficient technical safety quality. However, in this way, only train sets which are composed of two coupled railroad traction vehicles can be dealt with, in combination with the bus communication. A vehicle device in the center of the train set, i.e. a vehicle device of a railroad traction vehicle which is coupled on both sides, could fail to be detected since this vehicle device is not used for the travel operation, and therefore could be deactivated.

A further approach to a solution is based on combination of the bus communication with an additional direct communication connection between the adjacent vehicle devices. However, for this purpose each vehicle device has to be connected to the rear and to the front coupling of the railroad traction vehicle via two additional communication lines. Apart from the considerable expenditure, the assignment of a coupling connection, which is therefore no longer available for other functions, is disadvantageous.

The use of a train length selection switch in the driver's cab of the train set is also known, said switch being activated by the driver. The determination of the train length is therefore subject to the human error rate and therefore does not meet the requirements which are made of a modern train control system. In addition, the train length selection switch may also not be of a reliable design and therefore may be subject to error.

In order to eliminate this disadvantage, an input which is reliable in terms of signaling technology can be provided by the driver. In this context, a complex input procedure is necessary, for example by means of a driver's display. However, this input likewise does not satisfy the requirements which are made of a modern train control system.

BRIEF SUMMARY OF THE INVENTION

The invention is based on the object of specifying a method and a device for detecting the train length in a reliable fashion in terms of signaling technology when there is an unlimited number of coupled railroad traction vehicles.

The object is achieved according to the method in that the vehicle devices detect, by evaluating the coupling contacts, whether the railroad traction vehicle is coupled on one side or both sides, and in that the vehicle device of at least a first of the two railroad traction vehicles which are coupled on one side transmits a data telegram, containing its ID, by means of a digital I/O connection (input/output connection) to the vehicle device of the coupled railroad traction vehicle, which attaches its ID to the data telegram, wherein all the IDs of the coupled railroad traction vehicles are successively added to the data telegram, if appropriate by means of further vehicle devices and digital I/O connections and the data telegram is received by the vehicle device of the second railroad traction vehicle which is coupled on one side and the data telegram is evaluated with respect to the train length of the coupled railroad traction vehicles on the basis of the IDs.

In modern train control systems, the length of the associated railroad traction vehicle is known to each vehicle device. In order to determine the length of the train set, the IDs of the coupled railroad traction vehicles are evaluated in that the individual lengths of the railroad traction vehicles which correspond to the IDs of the railroad traction vehicles are added together. If only railroad traction vehicles of the same type are allowed to be coupled it is sufficient to multiply the railroad traction vehicle's own length by the number of transmitted IDs, i.e. the number of vehicle devices, in the train set.

At first, each vehicle device determines, by evaluating the coupling contacts, whether the railroad traction vehicle is coupled on one side or on both sides. The two outer vehicle devices, which are coupled only on one side, but at least one of these two vehicle devices, then transmit their ID, for example as binary number, via the digital I/O connection to the adjacent vehicle device. For this purpose, the digital output is merely activated or deactivated. The adjacent vehicle device receives the ID of the first vehicle device via the corresponding digital input and adds its own ID to the received data telegram and transmits this combined ID to the next vehicle device etc. The last vehicle device which, like the first, is coupled on only one side, knows the composition and the sequence of the individual railroad traction vehicles in the train set as a result of the reception of the ordered IDs of the other vehicle devices. This vehicle device, which is at the end in the train set, can subsequently determine the overall length of the train set. The digital transmission of the IDs from one end of the train set to the other end can also take place in both directions, when the reliability of the determination of the train length is improved even further by comparing the two results which are determined independently of one another.

In this way, a train length can be determined with the highest level of reliability in terms of the signaling equipment, if a train set is composed of any desired number of coupled railroad traction vehicles. It is particularly advantageous here that the determination of the train length is independent of the bus connection between the vehicle devices. Deactivation of the bus communication which functions incorrectly or which is provided in a way which is incompatible with the mode of operation does not have any influence on the determination of the train length. In addition to the train length, the sequence of the coupled railroad traction vehicles in the train set is also known and can likewise be used for safety-relevant processes, for example train control processes.

In one variant of the method, the object is also achieved by virtue of the fact that the vehicle devices detect, by evaluating the coupling contacts, whether the railroad traction vehicle is coupled on one side or on both sides, that the vehicle devices transmit their ID to the vehicle device/devices of the directly coupled railroad traction vehicle/vehicles, and that the resulting ID pairs are passed on via digital I/O connections to the vehicle device of at least one of the two railroad traction vehicles which are coupled on one side, wherein this vehicle device evaluates the ID pairs in terms of the train length of the coupled railroad traction vehicles.

In this variant, the IDs are transmitted only to the respectively adjacent vehicle device, wherein only these adjacent relationships, i.e. the ID pairs, are collected and evaluated in one vehicle device. Instead of a long data telegram with IDs which are connected to one another in series according to the first method variant, in this second method variant a plurality of relatively short data telegrams are produced, but said data telegrams have the same information content.

In both method variants, the data which are to be evaluated can be passed on to at least one further vehicle device for redundant evaluation. For this purpose, the reliable data telegrams are preferably distributed, via the non-secure digital I/O connections between the vehicle devices, to all the vehicle devices which are present in the train set, and are also evaluated there in terms of train length and/or sequence of the railroad traction vehicles coupled to one another. As a result, the error rate can be reduced even further.

In order to carry out both method variants, a device is provided which is characterized by the fact that the vehicle device is connected to the two couplings of the railroad traction vehicle via digital I/O assemblies (input/output assemblies).

In order to transmit technical safety information, a simple digital I/O assembly of low quality is therefore used, which is routed from the one vehicle coupling to the second vehicle coupling at the other end of the railroad traction vehicle and is, as it were, looped via the vehicle device. The vehicle device itself does not have to be in fully operationally capable state. The vehicle device must merely be capable of detecting the coupled state (on one side or both sides) and of activating the digital communication via the I/O assemblies in order to generate telegrams with their own ID. The actual functions of the vehicle device for controlling the railroad traction vehicle can be deactivated, which is customary in the case of middle railroad traction vehicles, i.e. ones which are coupled on both sides.

Furthermore with the inventive combination of the evaluation of coupling contacts and digital I/O connection, it is advantageous that standard I/O assemblies of very simple design can be used for the exchange of technical safety information, and that this digital I/O connection can be used jointly by secure and non-secure components. The same communication lines which form digital input and output can, for example, also be used for PLC. If digital I/O connections are already configured for other purposes, they can also be used for determining train length, since the determination of the train length is necessary only when the composition of the train set changes, and the determination of the train length consequently has only a very small resource requirement. Of course, the vehicle number or any other ID which is to be assigned unambiguously to the vehicle device can be used as a traction-vehicle-specific ID.

BRIEF DESCRIPTION OF THE SEVERAL VIEWS OF THE DRAWING

The invention is explained below with reference to a figurative illustration.

DESCRIPTION OF THE INVENTION

The FIGURE shows a train set which is composed of three railroad traction vehicles 1*a*, 1*b* and 1*c*, which each have a vehicle device 2*a*, 2*b* and 2*c*. The railroad traction vehicles 1*a*, 1*b* and 1*c* are mechanically and electrically connected to one another via couplings 3 and 4. In this context, the first and the third railroad traction vehicle 1*a* and 1*c* are coupled on one side, while the middle, second railroad traction vehicle 1*b* is coupled on both sides. Digital I/O connections 5*a*, 5*b* and 6*a*, 6*b* are each routed between digital outputs O and digital inputs I of the vehicle devices 2*a*, 2*b* and 2*c* via the couplings 3 and 4. Digital I/O connections are also routed as far as a coupling terminal 7 and 8 on the uncoupled sides of the railroad traction vehicles 1*a* and 1*c*.

In order to determine the train length of the train set with the three railroad traction vehicles 1*a*, 1*b* and 1*c*, the coupling contacts are firstly evaluated by means of the vehicle devices 2*a*, 2*b* and 2*c*, wherein the vehicle devices 2*a* and 2*c* detect coupling on one side, and the vehicle device 2*b* of the middle railroad traction vehicle 1*b* detects coupling on both sides.

In a first variant for determining train length, the two vehicle devices 2*a* and 2*c* which are coupled on one side transmit their traction-vehicle-specific ID, which is also traction-vehicle-length-specific, to the middle vehicle device 2*b* via the I/O connection 5*a* and 6*a*. This middle vehicle device 2*b* attaches at its own ID to the received data telegram and passes on this extended data telegram via the I/O connection 5*b* or 6*b* to the second vehicle device 2*c* or 2*a* which is coupled on one side. In at least one of these end-side vehicle devices 2*a* or 2*c*, the received IDs of the two other vehicle devices 2*a* and 2*b* or 2*c* and 2*b* are joined to the vehicle device's own ID, wherein both the overall length of the train set and the sequence of the railroad traction vehicles 1*a*, 1*b* and 1*c* which are coupled to one another are determined.

In a second variant for determining the train length of the entire train set, after the coupled state has been detected (coupling on one side or on both sides), the traction-vehicle-specific IDs are exchanged only between adjacent vehicle devices 2*a* and 2*b* as well as 2*b* and 2*c*. These ID pairs are then collected, via the digital I/O connections 5*a*, 5*b*, 6*a*, 6*b*, in at least one of the vehicle devices 2*a*, 2*b* and 2*c* and evaluated there with respect to the train length and the sequence of the coupled railroad traction vehicles 1*a*, 1*b* and 1*c*.

With both method variants it is possible to detect the train length of train sets with any desired number of coupled railroad traction vehicles in a way which is technically reliable. The digital I/O connections 5*a*, 5*b*, 6*a*, 6*b* can be embodied here as simple, digital I/O interfaces.

The invention claimed is:

1. A method for determining a train length of a plurality of coupled railroad traction vehicles each having a vehicle device with a traction-vehicle-specific identification number (ID), the method comprising the following steps:

detecting if a railroad traction vehicle is coupled on one side or both sides by evaluating coupling contacts with the vehicle devices;

transmitting the IDs from the vehicle devices of the railroad traction vehicles to the vehicle device or devices of the railroad traction vehicle or vehicles directly coupled thereto to form resulting ID pairs;

passing on the resulting ID pairs through digital I/O connections to the vehicle device of at least one of two railroad traction vehicles being coupled on one side; and evaluating the ID pairs in terms of the train length of the coupled railroad traction vehicles with the vehicle device of the at least one of the two railroad traction vehicles receiving the resulting ID pairs to determine the train length.

2. The method according to claim 1, which further comprises passing on data to be evaluated to at least one further vehicle device for redundant evaluation.

3. A device for carrying out the method according to claim 1, the device comprising:

a railroad traction vehicle having a vehicle device;

two coupling contacts; and digital I/O [input/output] assemblies connecting said vehicle device to said two coupling contacts.

* * * * *